US011668537B2

(12) United States Patent
Stickling et al.

(10) Patent No.: US 11,668,537 B2
(45) Date of Patent: Jun. 6, 2023

(54) SPRAY WASHING CART APPARATUS

(71) Applicant: Johannes Stickling, Philadelphia, PA (US)

(72) Inventors: Johannes Stickling, Philadelphia, PA (US); Matthew Mooradian, Nassau, NY (US)

(73) Assignee: Johannes Stickling, Philadelphia, PA (US)

( * ) Notice: Subject to any disclaimer, the term of this patent is extended or adjusted under 35 U.S.C. 154(b) by 313 days.

(21) Appl. No.: 17/026,563

(22) Filed: Sep. 21, 2020

(65) Prior Publication Data

US 2022/0090871 A1 Mar. 24, 2022

(51) Int. Cl.

| | |
|---|---|
| ***F28G 15/02*** | (2006.01) |
| ***F28G 1/16*** | (2006.01) |
| ***F28G 9/00*** | (2006.01) |
| ***F28G 15/04*** | (2006.01) |

(52) U.S. Cl.

CPC ..... *F28G 15/02* (2013.01); *F28G 1/166* (2013.01); *F28G 9/00* (2013.01); *F28G 15/04* (2013.01)

(58) Field of Classification Search

CPC ..... F28G 15/02

See application file for complete search history.

(56) References Cited

U.S. PATENT DOCUMENTS

| | | | |
|---|---|---|---|
| 7,730,979 | B2 | 6/2010 | Kahrig |
| 9,452,848 | B2 | 9/2016 | McDermott |
| 10,473,413 | B1 | 11/2019 | Laird et al. |
| 2016/0084595 | A1 | 3/2016 | Stickling et al. |
| 2017/0160025 | A1 | 6/2017 | Stickling et al. |
| 2019/0101343 | A1 | 4/2019 | Mooradian et al. |

FOREIGN PATENT DOCUMENTS

| | | | |
|---|---|---|---|
| CN | 103736685 | B | 3/2016 |
| CN | 107497744 | A | 12/2017 |
| CN | 107716353 | A | 2/2018 |

*Primary Examiner* — Jason Y Ko

(74) *Attorney, Agent, or Firm* — Richard M. Goldberg

(57) ABSTRACT

A spray washing cart apparatus, including: a cart (10); a nozzle array holder (14); at least one cleaning nozzle array (16.1) arranged on the nozzle array holder (14), the cleaning nozzle array (16.1) including a plurality of spray nozzles (18.1) for spray washing; a water distribution manifold (20, 22) for supplying water to the cleaning nozzle array (16.1); and a water pump (24) connectable to the cleaning nozzle array (16.1) through the manifold (20, 22), wherein the water pump (24) is mounted on the cart (10), wherein the cleaning nozzle array (16.1) extends in a first direction (1), and wherein the nozzle array holder (14) is mounted on a top side of the cart (10) to be linearly moveable in a second direction (2) transverse to the first direction (1).

18 Claims, 3 Drawing Sheets

SPRAY WASHING CART APPARATUS

FIELD OF THE INVENTION

The invention relates to cleaning a cooler or cooling array of a heat exchanger or condenser of, for example, an industrial vehicle, in particular of a wheel loader.

BACKGROUND OF THE INVENTION

In an industrial vehicle, the excess heat produced by the vehicle is delivered to the cooler of the vehicle to emit the heat to the environment. The coolers, which form a generally flat, rectangular, vertical field, consist of cooling tubes or cooling tube arrays. The cooling tubes are fin tubes, i.e. tubes having cooling fins integrally mounted or formed thereon. The cooling liquid flows through the cooling tubes and transmits the heat to the cooling fins. Fans may be installed next to the cooling tube arrays to create a flow of ambient air along the cooling tubes for cooling the fins.

Because industrial vehicles are generally used outside or in dusty environments the ambient air transports dust and dirt which accumulates on the cooling tube arrays. Resulting cooling performance deficits may involve performance deficits or overheating of the vehicle, so that cleaning is required.

Conventionally, a cooling array of, for example, a large wheel loader is cleaned manually, which is hard work. However, large vertical cooling tube or cooling fin arrays may have sizes of 2 to 2.5 meters by up to 3 by 5 meters. Manually cleaning large vertical cooling tube array proves difficult and is hard work. Moreover, because the cooler of an industrial vehicle is typically accessible from one side only, in some cooler designs, parts of the cooling tube array can be folded out, further complicating the cleaning process.

US 2016/0084595 A1 and US 2017/0160025 A1 describe a high-pressure cleaning apparatus for cleaning an inclined cooling tube array on a roof of a large scale power station. US 2019/0101343 A1 describes a similar apparatus with a nozzle array that is moved above the inclined heat exchanger of a power station.

SUMMARY OF THE INVENTION

It is an object of the present invention to provide a cleaning apparatus that facilitates cleaning of a vertical cooler of a construction vehicle.

A further object of the invention is to provide a cleaning apparatus which allows a high cleaning water output pressure to clean a vertical cooling array of a construction vehicle.

A further object of the invention is to provide a cleaning apparatus which is easy to handle and which facilitates the manual work when cleaning a vertical cooler of a construction vehicle.

A further object of the invention is to provide a cleaning apparatus for cleaning a cooler of a construction vehicle which is easy to assemble and/or arrange on site.

A further object of the invention is to provide a cleaning apparatus for cleaning a cooler of a construction vehicle which simplifies the manufacturing thereof.

The invention is indicated in the independent claims. Further embodiments are indicated in the dependent claims.

To better address one or more of these objects, in a first embodiment of the invention there is provided a spray washing cart apparatus, comprising: a cart; a nozzle array holder; at least one cleaning nozzle array arranged on the nozzle array holder, the cleaning nozzle array comprising a plurality of spray nozzles for spray washing; a water distribution manifold for supplying water to the cleaning nozzle array; and a water pump connectable to the cleaning nozzle array through the manifold, wherein the water pump is mounted on the cart, wherein the cleaning nozzle array extends in a first direction, wherein the nozzle array holder is mounted on a top side of the cart to be linearly moveable in a second direction transverse to the first direction. The spray nozzles may be spray nozzles for high pressure spray washing, and the water pump may be a high-pressure water pump.

The apparatus allows the cleaning of a cooler, e.g. the cooler of a wheel loader, in a flexible and compact manner. The cart apparatus can be moved into the working position wherein it may be arranged in front of a cooler. The extension of the cleaning nozzle array and the movable nozzle array holder allow the pressure cleaning of a large area of the cooler in a short amount of time and with minimal manual labor. This vastly reduces cleaning costs and allows an efficient cleaning process. Especially for essential vehicles of a company, the down time is reduced and reliability is improved.

The cart allows the movement of the cart apparatus into its working position. The apparatus may be a spray washing cart apparatus for cleaning a cooler of a construction vehicle. The plurality of spray nozzles may be a plurality of spray nozzles for high pressure spray washing a cooler, such as a cooler of a construction vehicle. The cooler may comprise an array of cooling fins, for example. The construction vehicle may be a wheel loader. The working position may be a working position at a cooler of a construction vehicle. The working position may be a parking position of the cart apparatus.

Due to the nozzle array holder being moveable in the second direction transverse to the first direction of the extension of the cleaning nozzle array, a cleaning area may be easily cleaned that extends in both the first and the second direction.

For example, a plurality of spray nozzles of at least one cleaning nozzle array may be distributed along the first direction.

The nozzle array holder is mounted on a top side of the cart to be linearly moveable in a second direction transverse to the first direction. That is, the nozzle array holder is linearly moveable with respect to the cart. For example, the nozzle array holder may be mounted on a top side of the cart, in the working position of the cart apparatus.

Preferably, the spray nozzles of at least one first cleaning nozzle array are oriented for spraying water in a third direction.

Preferably, one of the first and second directions is a vertical direction. For example, one of the first and second directions is a vertical direction in the working position of the cart apparatus.

Preferably, the second direction is substantially transverse to the first direction. For example, the first direction may be vertical, and the second direction may be horizontal. In particular, the first direction may be vertical, and the second direction may be horizontal in the working position of the cart apparatus. In other embodiments, for example, the first direction may be horizontal, and the second direction may be vertical. In particular, the first direction may be horizontal, and the second direction may be vertical in the working position of the cart apparatus.

Preferably, the spray nozzles of at least one cleaning nozzle array are oriented for spraying water in a third direction. Preferably, the third direction is substantially transverse to the first and the second directions; further preferably, the third direction may be horizontal. Hereby, the nozzles are oriented, so that they can spray and clean a plane or area that is defined by the first and the second direction. Preferably, the third direction is transverse to one side of the cart.

Preferably, the nozzle array holder is linearly moveable in the second direction for letting a spraying swath of the cleaning nozzle array scan a two-dimensional cleaning area.

For example, the cleaning area is outside the cart apparatus. The cleaning area may be in front of the cleaning nozzle array.

The nozzle array holder including the plurality of nozzles may be moved to scan the two-dimensional cleaning area. For example, the cleaning area may be defined by the extension of the cleaning nozzle array in one direction (for example, the first direction) and a movement path of the cleaning nozzle array and nozzle array holder in a cross direction (the second direction). For example, the cleaning area may extend in the first and the second direction. For example, the cleaning zone may be disposed above the cart. For example, a cleaning swath width may be defined by a width of the cleaning nozzle array.

Preferably, the spray washing cart apparatus comprises at least two cleaning nozzle arrays of which at least one second cleaning nozzle array extends in one other direction than the first direction.

Preferably, the one other direction than the first direction of the second cleaning nozzle array is a direction forming an angle between 1 and 180 degrees with the first direction and, thereby, with the first cleaning nozzle array. Hereby, the apparatus may be configured to scan a three-dimensional cleaning area or a cleaning area including two non-coplanar cleaning subareas, and the apparatus may be configured for cleaning curved or angled coolers or cooler parts simultaneously, further improving efficiency of the cleaning process. In particular, the first direction and the one other direction may both be horizontal.

Preferably, the at least one second cleaning nozzle array extends in the third direction.

For example, the first direction and the third direction may both be horizontal.

Preferably, the spray nozzles of the at least one second cleaning nozzle array are oriented for spraying water in the first direction (a spraying direction).

For example, the spray nozzles of the first cleaning nozzle array may be oriented in the third direction, and the spray nozzles of the at least one second cleaning nozzle array may be oriented in the first direction, or in a direction opposite to the first direction. This results in a transverse arrangement of the orientation of at least the spray nozzles of the second cleaning nozzle array with respect to the spray nozzles of the first cleaning nozzle array.

For example, different cleaning nozzle arrays may have spray nozzles oriented for spraying water in respective different directions (in a respective spraying direction of the spray nozzles of the respective cleaning nozzle array). Each of these directions may be at a substantially right angle to the respective nozzle array holder. For example, each of these directions may be substantially horizontal.

Preferably, the spray nozzles of the at least one cleaning nozzle array project outward beyond at least one side of the cart.

For example, the spray nozzles of the at least one cleaning nozzle array may project laterally beyond at least one side of the cart. The at least one side may be at least one of a front side, a left side, a right side, or a rear side of the cart.

For example, the at least one cleaning nozzle array and/or the nozzle array holder may form an outermost part or outermost parts of the cart apparatus in a spraying direction of the respective cleaning array. For example, the spraying direction may be a substantially horizontal direction. For example, the at least one cleaning nozzle array and/or the nozzle array holder may protrude over the cart in said spraying direction of the respective cleaning array. For example, the at least one cleaning nozzle array may project forward or laterally beyond the cart.

Preferably, the spray washing cart apparatus further comprises a longitudinal guide extending in the second direction, and wherein the nozzle array holder is linearly movable along said guide.

The guide may comprise one or more of a guide rail, guide rails, a guide bar, guide bars, a guide track, guide tracks, etc. For example, the guide is fixed on the top side of the cart. The guide may be vertically erected on the cart.

Preferably, the spray washing cart apparatus further comprises a drive for moving the nozzle array holder forth and/or back in the second direction.

That is, the drive may move the nozzle array holder including the plurality of nozzles to scan the two-dimensional cleaning area. For example, the drive may move the nozzle array holder along the guide.

Preferably, the water distribution manifold comprises a movable duct, configured to supply water to the cleaning nozzle array while the nozzle array holder is moved.

Preferably, the duct may comprise a flexible tube. For example, the tube may be guided along the guide or by the guide.

The nozzle array holder may also be movable in the first direction. For example, the holder may be linearly movable in the first direction. This allows the apparatus to clean different cleaning areas that may extend beyond the extension of the first cleaning nozzle array in the first direction without having to adjust the position of the apparatus itself. For example, the nozzle array holder may be linearly movable along a guide extending in the first direction. For example, the apparatus may comprise a drive for moving the nozzle array holder forth and/or back in the first direction.

Preferably, the water distribution manifold comprises at least one valve for selectively supplying water to cleaning nozzles of the cleaning nozzle array.

For example, the spray washing cart apparatus may comprise at least two cleaning nozzle arrays of which at least one second cleaning nozzle array extends in one other direction than the first direction, and wherein the water distribution manifold comprises at least two valves for selectively supplying water to cleaning nozzles of a first one of the cleaning nozzle arrays and/or a second one of the cleaning nozzle arrays.

Preferably, the spray washing cart apparatus further comprises a controller configured to control the movement of the nozzle array holder. In particular, the controller may be configured to control the movement of the nozzle array holder in the second direction. The controller may further be configured to control the movement of the nozzle array holder in the first direction.

For example, the drive may be connected to the controller. The controller may be configured to control the drive for controlling the movement of the nozzle array holder. For example, the controller may be configured to raise and/or lower the nozzle array holder. For example, the controller may perform wireless control of the drive.

Preferably, the spray washing cart apparatus further comprises at least one limit switch for limiting the movement of the nozzle array holder.

Preferably, the at least one limit switch may be connected to the controller. This allows the controller to limit the movement of the nozzle array.

Preferably, the cart is manually movable.

For example, the cart may be manually movable into the working position at a construction vehicle. Preferably, the cart may comprise a handle bar and/or a grip by which it is manually movable.

Preferably, the second direction is a vertical direction, and wherein the cart apparatus comprises at least three cleaning nozzle arrays arranged on the nozzle array holder, of which a second cleaning nozzle array and a third cleaning nozzle array each extend in one other direction than the first direction, the cleaning nozzle arrays being arranged in a horizontal U-shape.

Herein, the cleaning nozzle array extending in the first direction may be referred to as a first cleaning nozzle array. For example, the second and third cleaning nozzle array may extend in the third direction. For example, the second cleaning nozzle array may comprise spray nozzles oriented for spraying water in the first direction. For example, the third cleaning nozzle array may comprise spray nozzles oriented for spraying water in a direction opposite to the first direction, and/or at a substantially right angle to a spraying direction of spray nozzles of the first cleaning nozzle array.

For example, the cooler of an industrial vehicle may be configured with one or two additional cooler wings that may be unfolded to form an L-shaped or U-shaped unfolded cooler arrangement of a first cooler and one or two cooler wings. The cart apparatus may be configured to be positioned inside the L-shaped or U-shaped unfolded cooler arrangement, for cleaning the cooler wing or wings as well as the first cooler. Thus, the cart apparatus may be able to clean all parts of the cooler simultaneously.

For example, the spray washing cart apparatus may be configured to clean the cooler in a parking position of the cart. For example, the parking position of the cart may correspond to the working position of the cart apparatus.

Preferably, the cart further comprises at least three wheels on the bottom side of the cart.

Preferably, at least one wheel is a steerable wheel.

Preferably, the cart further comprises at least one brake for locking at least one wheel in a parking position of the cart.

For example, the brake locks the wheel in a parking position and/or working position of the cart apparatus.

Preferably, the spray washing cart apparatus further comprises at least one fastener for attaching a strap or belt to the cart apparatus. This may serve for securing the cart apparatus to the construction vehicle, for example.

For example, the at least one fastener may be adapted for securing the cart apparatus to the construction vehicle in the parking position of the cart. Preferably, the apparatus may comprise at least two fasteners located on opposite ends of the cart. Hereby the cart may be secured without obstructing the nozzle array holder and/or the cleaning area.

Preferably, the spray washing cart apparatus further comprises a bumper at a first side of the cart. The buffer may be configured for buffering a contact of the cart apparatus, in particular of the cart, with the construction vehicle. The bumper may include an elastic material.

BRIEF DESCRIPTION OF THE DRAWINGS

The present invention will become more fully understood from the detailed description of a preferred embodiment given herein below and the accompanying drawings, and wherein.

DETAILED DESCRIPTION

Figure 1:
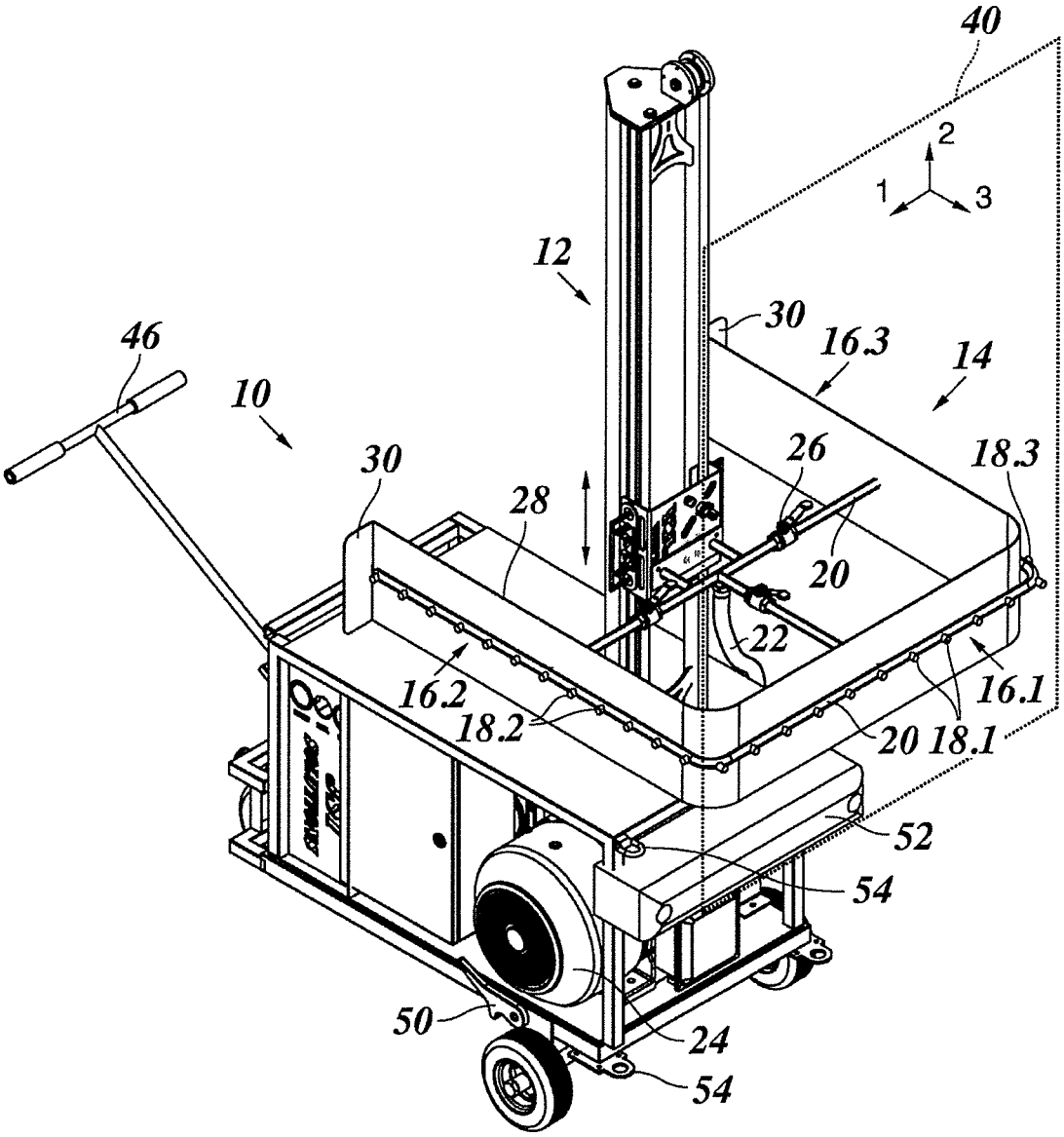
FIG. 1 is a schematic perspective view of a spray washing cart apparatus.
Figure 2:
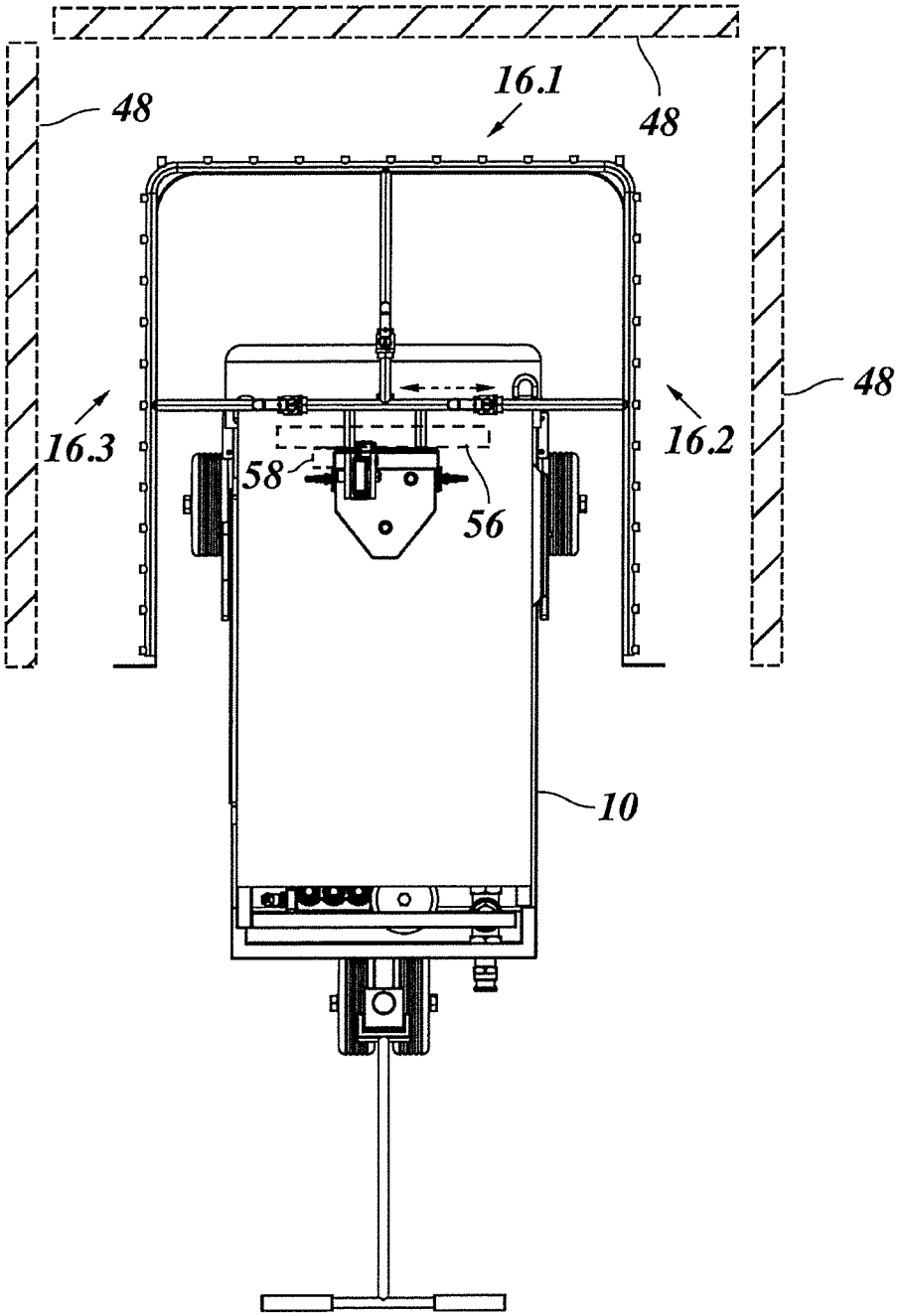
FIG. 2 is a schematic top view of the apparatus.
Figure 3:
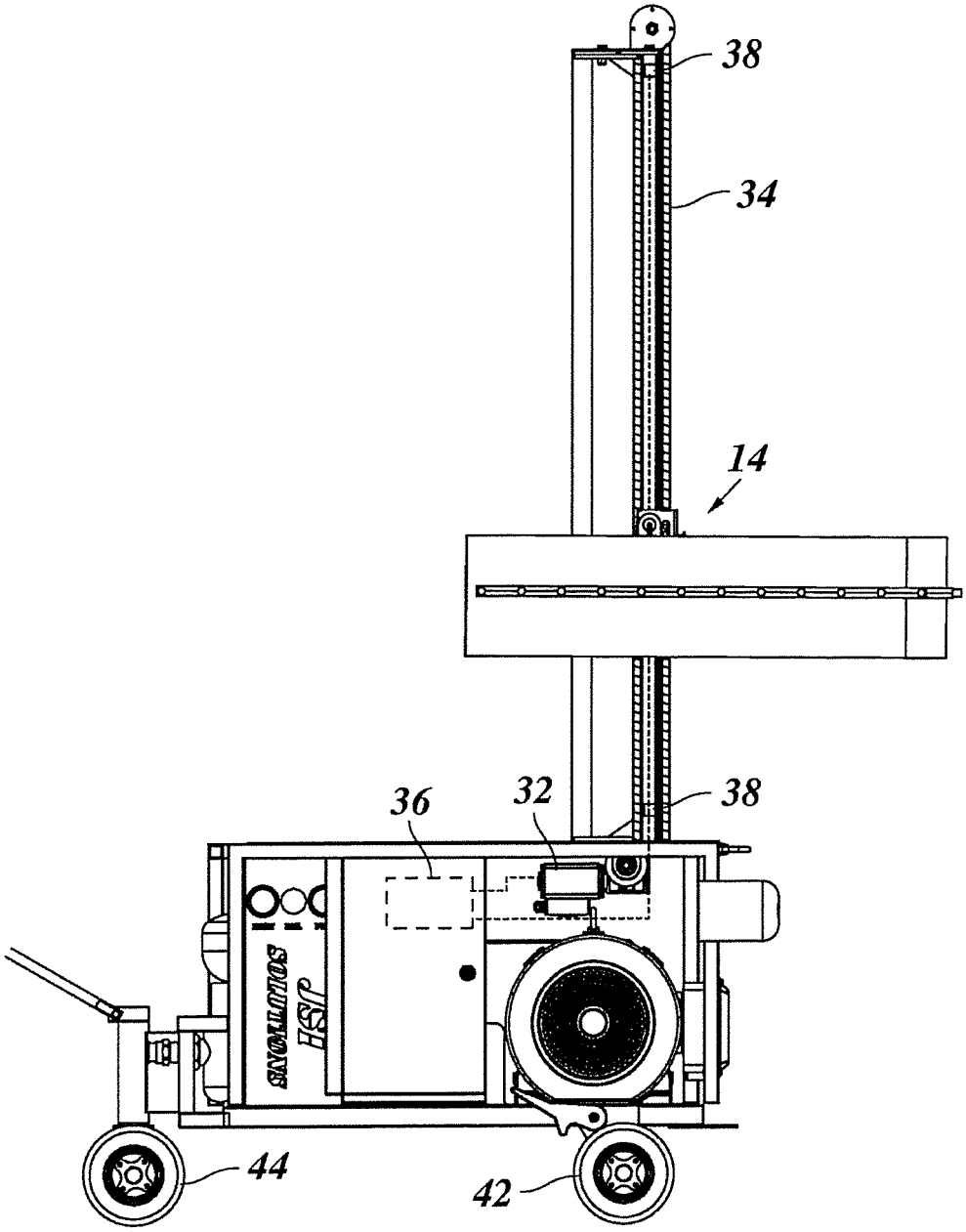
FIG. 3 is a schematic side view of the apparatus.

The spray cart washing apparatus shown in FIGS. 1 to 3 is a spray cart washing apparatus for cleaning a cooler of a construction vehicle, in particular a wheel loader.

The spray washing cart apparatus includes a cart 10, on top of which a longitudinal guide 12 is vertically erected. A nozzle array holder 14 is mounted to the guide 12 to be linearly movable in the vertical direction along the guide 12.

The nozzle array holder 14 holds three cleaning nozzle arrays 16.1, 16.2, 16.3, which each include a respective plurality of spray nozzles 18.1, 18.2 and 18.3. The nozzle array holder 14 further holds a piping 20 connected by a movable duct 22 in the form of a hose to a high pressure water pump 24 that is arranged on the cart 10. The piping 20 and movable duct 22 form a water distribution manifold 20, 22 for supplying water from the pump 24 to the cleaning nozzle arrays 16.1, 16.2, 16.3. The water distribution manifold 20, 22 further includes valves 26 for selectively supplying the water to the respective cleaning nozzle arrays 16.1, 16.2 and 16.3 and their cleaning nozzles 18.1, 18.2, 18.3. For example, the cleaning nozzle arrays 16.1, 16.2, 16.3 are separately connectable to the pump 24 by respective valves 26.

In the example, the first cleaning nozzle array 16.1 extends in a horizontal, first direction 1 transverse across the spray washing cart apparatus and is arranged in a frontmost position of the spray washing cart apparatus in a third direction 3. The spray nozzles 18.1 of the first cleaning nozzle array 16.1 are oriented for spraying water in the third direction 3, which is a horizontal, front direction in the example shown.

The vertical direction, in which the nozzle array holder 14 is movable along the guide 12, is a vertical, second direction 2.

The apparatus further includes a shielding plate 28 arranged behind the respective cleaning nozzle arrays 16.1, 16.2, 16.3 and having outwardly bent wings 30 at its respective ends. The shielding plate 28 is arranged at and forms a part of the nozzle holder 14.

The apparatus includes a drive 32 for moving the nozzle array holder 14 upwards and downwards along the guide 12. Driving force is transferred from the drive 32 to the nozzle array holder 14 via a toothed belt 34 shown in FIG. 3, or by a simple belt or a gearing mechanism. The drive 32 is mounted on the cart 10. However, in other embodiments, the drive may be mounted on the nozzle array holder. A controller 36 controls the drive 32 for controlling the movement of the nozzle array holder 14. Limit switches 38 for limiting the movement of the nozzle array holder 14 are connected to the controller 36.

Each of the nozzle arrays 16.1, 16.2, 16.3 is configured for generating a spraying swath, which will be described in the following for the case of the first cleaning nozzle array 16.1. The cleaning nozzle array 16.1 is configured for generating a spraying swath directed in the third direction 3 and having a crosswise extension in a horizontal direction, which is the first direction 1 for the first cleaning nozzle array 16.1. When the nozzle array holder 14 is vertically moved in the second direction 2 or opposite thereto, the spraying swath of the first cleaning nozzle array 16.1 scans a two-dimensional cleaning area 40 schematically shown with dotted lines in FIG. 1. For the first cleaning nozzle array 16.1, a plane of the cleaning areas extends in the first and second directions 1, 2.

The second cleaning array 16.2 extends in the third direction 3, and its cleaning nozzles 18.2 are directed in the first direction 1. Accordingly, a plane of a two-dimensional cleaning area of the second cleaning nozzle area 16.2 extents in the second and third directions 2, 3. Similarly, the third cleaning nozzle array 16.3 has cleaning nozzles 18.3 directed opposite to the first direction 1, while a plane of a two-dimensional cleaning area extends in the second and third directions 2, 3.

As shown, the cleaning nozzle arrays 16.1, 16.2, 16.3 are arranged in a horizontal U-shape.

As shown in FIG. 2, the spray nozzles 18.1, 18.2, 18.3 of the respective cleaning nozzle arrays 16.1, 16.2, 16.3 project outward beyond the respective side of the cart 10. The cart 10 has two non-steerable front wheels 42 and a steerable double-wheel 44 connected to a handle bar 46 for manually moving and steering the cart 10.

FIG. 2 shows the spraying cart apparatus arranged in a working position, in which each of the cleaning nozzle arrays 16.1, 16.2, 16.2 is arranged in front of a cooler part or a cooler section 48 of a wheel loader. The cooler section 48 may, for example, include an array of cooling fins to be cleaned. Wheels 42 may be locked by brakes 50, in the working or parking position of the apparatus.

On the front side of the cart 10, there is arranged a bumper 52 for contacting the wheel loader. The apparatus may be attached to the wheel loader using fasteners 54 for attaching straps or belts.

In a further embodiment, the above described apparatus includes a further guide 56, which may be a horizontal guide. The nozzle array holder 14 may be linearly movable along the further guide 56 in the first direction. The nozzle array holder 14 may be mounted to the first guide 12 by the further guide 56. The apparatus may include a further drive 58 for moving the nozzle array holder 14 forth and/or back in the first direction, as schematically shown with dashed lines in FIG. 2.

What is claimed is:

1. A spray washing cart apparatus, comprising:
a cart;
a nozzle array holder;
at least one cleaning nozzle array arranged on the nozzle array holder, each cleaning nozzle array comprising a plurality of spray nozzles for spray washing;
a water distribution manifold for supplying water to the at least one cleaning nozzle array; and
a water pump connectable to the at least one cleaning nozzle array through the manifold, wherein the water pump is mounted on the cart,
wherein at least one first said cleaning nozzle array extends in a first direction,
wherein the nozzle array holder is mounted on a top side of the cart to be linearly moveable in a second direction transverse to the first direction, and
wherein the at least one cleaning nozzle array comprises at least two cleaning nozzle arrays of which at least one second said cleaning nozzle array extends in one other direction than the first direction.

2. The spray washing cart apparatus according to claim 1, wherein the nozzle array holder is linearly moveable in the second direction for letting a spraying swath of the cleaning nozzle array scan a two-dimensional cleaning area.

3. The spray washing cart apparatus according to claim 1, wherein the at least one second cleaning nozzle array extends in a third direction.

4. The spray washing cart apparatus according to claim 3, wherein the spray nozzles of the at least one second cleaning nozzle array are oriented for spraying water in the first direction.

5. The spray washing cart apparatus according to claim 1, wherein the spray nozzles of the at least one cleaning nozzle array project outward beyond at least one side of the cart.

6. The spray washing cart apparatus according to claim 1, further comprising a longitudinal guide extending in the second direction, and wherein the nozzle array holder is linearly movable along said guide.

7. The spray washing cart apparatus according to claim 1, further comprising a drive for moving the nozzle array holder one of:
in the second direction,
a direction opposite to the second direction, and
both the second direction and the direction opposite to the second direction.

8. The spray washing cart apparatus according to claim 1, wherein the water distribution manifold comprises a movable duct, configured to supply water to the at least one cleaning nozzle array while the nozzle array holder is moved.

9. He spray washing cart apparatus according to claim 1, wherein the water distribution manifold comprises at least one valve for selectively supplying water to cleaning nozzles of the at least one cleaning nozzle array.

10. The spray washing cart apparatus according to claim 1, further comprising a controller configured to control movement of the nozzle array holder in the second direction.

11. The spray washing cart apparatus according to claim 1, further comprising at least one limit switch for limiting the movement of the nozzle array holder.

12. The spray washing cart apparatus according to claim 1, wherein the cart is manually movable.

13. A spray washing cart apparatus, comprising:
a cart;
a nozzle array holder;
at least one cleaning nozzle array arranged on the nozzle array holder, each cleaning nozzle array comprising a plurality of spray nozzles for spray washing;
a water distribution manifold for supplying water to the at least one cleaning nozzle array; and
a water pump connectable to the at least one cleaning nozzle array through the manifold, wherein the water pump is mounted on the cart,
wherein at least one first said cleaning nozzle array extends in a first direction,
wherein the nozzle array holder is mounted on a top side of the cart to be linearly moveable in a second direction transverse to the first direction, and
wherein the second direction is a vertical direction, and wherein the at least one cleaning nozzle array comprises at least three cleaning nozzle arrays arranged on the nozzle array holder, of which a second said cleaning nozzle array and a third said cleaning nozzle array each extend in one other direction than the first direction, the cleaning nozzle arrays being arranged in a horizontal U-shape.

14. The spray washing cart apparatus according to claim 1, wherein the cart further comprises at least three wheels on the bottom side of the cart.

15. The spray washing cart apparatus according to claim 14, wherein at least one wheel is a steerable wheel.

16. The spray washing cart apparatus according to claim 14, wherein the cart further comprises at least one brake for locking at least one said wheel in a parking position of the cart.

17. The spray washing cart apparatus according to claim 1, further comprising at least one fastener for attaching one of:

a strap or a belt to the cart apparatus.

18. The spray washing cart apparatus according to claim 1, further comprising a bumper at a first side of the cart.

* * * * *